US011242116B2

(12) United States Patent
Guo et al.

(10) Patent No.: US 11,242,116 B2
(45) Date of Patent: Feb. 8, 2022

(54) TOWING ANCHOR CAPABLE OF EXTENDING WING PLATE AND INSTALLATION METHOD THEREFOR

(71) Applicant: ZHEJIANG UNIVERSITY, Hangzhou (CN)

(72) Inventors: Zhen Guo, Hangzhou (CN); Lizhong Wang, Hangzhou (CN); Shengjie Rui, Hangzhou (CN); Yi Hong, Hangzhou (CN); Lingling Li, Hangzhou (CN); Yuzhe Dou, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 16/960,558

(22) PCT Filed: Aug. 30, 2019

(86) PCT No.: PCT/CN2019/103739
§ 371 (c)(1),
(2) Date: Jul. 8, 2020

(87) PCT Pub. No.: WO2020/048400
PCT Pub. Date: Mar. 12, 2020

(65) Prior Publication Data

US 2021/0371052 A1 Dec. 2, 2021

(30) Foreign Application Priority Data

Sep. 6, 2018 (CN) ..... 201811039697.8

(51) Int. Cl.
*B63B 21/24* (2006.01)
*B63B 21/20* (2006.01)
*B63B 21/26* (2006.01)

(52) U.S. Cl.
CPC ..... *B63B 21/243* (2013.01); *B63B 21/20* (2013.01); *B63B 21/26* (2013.01); *B63B 2021/203* (2013.01); *B63B 2021/262* (2013.01)

(58) Field of Classification Search
CPC ..... B63B 21/24; B63B 21/243; B63B 21/20; B63B 21/26; B63B 2021/203; B63B 2021/262
See application file for complete search history.

(56) References Cited

FOREIGN PATENT DOCUMENTS

CN 101596927 A 12/2009
CN 105377688 A 3/2016
(Continued)

OTHER PUBLICATIONS

International Search Report (PCT/CN2019/103739 ); dated Nov. 27, 2019.

*Primary Examiner* — Anthony D Wiest
(74) *Attorney, Agent, or Firm* — W&G Law Group

(57) ABSTRACT

A towing anchor capable of extending wing plate and an installation method therefor are provided. The towing anchor includes a main anchor plate and two wing plates which can slide outwards relative to the main anchor plate and will not be detached from the main anchor plate. The main anchor plate is anchored with a mooring steel cable connected to a towing vessel. The main anchor plate is further provided with a limit cable-receiving groove, in which first, second and third fixed pulleys are respectively provided correspondingly to each of the two wing plates. One end of a tensioning steel cable is fixed to an inner edge of the wing plate, and the other end of the tensioning steel cable sequentially surrounds the third, second, and first fixed pulleys and then passes through an opening formed at middle position of the groove to be connected to the towing vessel.

8 Claims, 5 Drawing Sheets

(56) References Cited

FOREIGN PATENT DOCUMENTS

| | | | | |
|---|---|---|---|---|
| CN | 107237308 | A | | 10/2017 |
| CN | 207496890 | U | | 6/2018 |
| CN | 108668974 | A | * | 10/2018 |
| CN | 109178209 | A | | 1/2019 |
| CN | 208908878 | U | * | 5/2019 |
| RU | 2025392 | C1 | | 12/1994 |
| WO | 0050301 | A1 | | 8/2000 |

* cited by examiner

TOWING ANCHOR CAPABLE OF EXTENDING WING PLATE AND INSTALLATION METHOD THEREFOR

TECHNICAL FIELD

The present disclosure relates to a towing anchor and an installation method therefor, and in particular, to a towing anchor capable of extending a wing plate and an installation method therefor.

BACKGROUND

The South China Sea has the most exploitable oil and gas resources in the world that have not been exploited on a large scale. Development of the oil and gas resources in the South China Sea is of great significance to China's promotion of a "marine power" strategy. As exploitation of offshore oil resources continues to expand into a deep sea, large and ultra-large floating structures are gradually increasing, thereby placing higher demands on mooring systems. Currently, anchoring foundations widely used in marine engineering include towing anchors, suction anchors and high holding power anchors, in which the towing anchors are widely used in anchor designs of floating structures due to their fast towing installation and a remarkable anti-pull capability.

However, a traditional towing anchor generally has a small dimension, this is because that in one aspect, an excessively large dimension will greatly increase resistance when it penetrates, thereby increasing requirements for an installation power equipment; and in another aspect, the large dimension will also cause some difficulties in transportation. However, bearing capacity of the towing anchor having a relatively small dimension may not meet design requirements, so its application in large structures is affected. Therefore, the present disclosure proposes a new type of towing anchor, which significantly increases a force bearing area of an anchor plate during operation under a premise of not increasing the difficulty of transportation and installation, thereby improving the bearing capacity of the towing anchor.

SUMMARY

In view of the deficiencies in the related art, an object of the present disclosure is to provide a towing anchor capable of extending a wing plate and an installation method therefor. This type of anchor has following advantages: in terms of force bearing, by extending the wing plate, a force bearing area of the towing anchor is greatly increased, thereby greatly increasing bearing capacity of the anchor; in terms of installation, it also has advantages of traditional towing anchors where towing installation is performed through a vessel, without generating additional installation resistance; in addition, it can be retracted during transportation, saving space and facilitating transportation.

The present disclosure adopts a following technical aspect.

A towing anchor capable of extending a wing plate is provided, including: a main anchor plate having an anchor tip; and two wing plates. Lower surfaces of four corners of the main anchor plate are each provided with a baffle, an end of each of the twos wing plates is provided with a wing plate sliding baffle, the two wing plates are symmetrically arranged under the main anchor plate, and when the wing plate slides relative to the main anchor, the two wing plates are not detached from the main anchor plate due to the baffles and the wing plate sliding baffles, the main anchor plate is provided with four snap rings respectively tied with a mooring steel cable, and the four steel cables are combined into one strand by a steel cable joint to be connected to a towing vessel, the main anchor plate is provided with a limit cable-receiving groove, and an opening is formed at a middle position of the limit cable-receiving groove, in the limit cable-receiving groove, a first fixed pulley is provided correspondingly to an inner edge of each of the two wing plates, and a second fixed pulley is provided correspondingly to an outer edge of each of the two wing plates, two outer edges of the main anchor plate are each provided with a third fixed pulley, one end of a tensioning steel cable penetrates into a gap between the wing plate and the main anchor plate and is fixed to the inner edge of the wing plate, and the other end of the tensioning steel cable sequentially surrounds the third, second, and first fixed pulleys and then passes through opening formed at the middle position of the limit cable-receiving groove to be connected to the towing vessel.

In the above technical aspect, furthermore, the baffle can be an L-shaped baffle, the wing plate is located in a gap between the L-shaped baffle and the main anchor plate, and the wing plate sliding baffle is provided at the inner edge of the wing plate.

Furthermore, the wing plate sliding baffle may be a stopping block corresponding to two baffles, or the wing plate sliding baffle may be a stopping strip provided at an entire inner edge of the wing plate.

Furthermore, the limit cable-receiving groove is formed by fixing a strip-shaped cover on the main anchor plate, to avoid damage to the tensioning steel cable and the fixed pulleys during towing.

An installing method for the towing anchor capable of extending a wing plate is as follows. When towing, the two wing plates are in a retracted state, the towing anchor is embedded into a seabed at a certain angle by the towing vessel through the mooring steel cable, in such a manner that the towing anchor is at a depth deeper than a pre-embedded position by 1 to 2 times a width of the main anchor plate; when tensioning, the towing anchor is pulled upwards as a whole by pulling the mooring steel cable, and at the same time, by pulling the tensioning steel cable, the two wing plates slide outwards to extend, so that operation starts once being connected to a floating platform.

The present disclosure has following advantages.

In terms of force bearing, by extending the wing plate, a force bearing area of the towing anchor is greatly increased, thereby greatly increasing bearing capacity of the anchor; in terms of installation, it also has advantages of traditional towing anchors where towing installation is performed through a vessel, without generating additional installation resistance; in addition, it can be retracted during transportation, saving space and facilitating transportation.

1. main anchor plate;
2. wing plate;
3. first fixed pulley;
4. second fixed pulley;
5. third fixed pulley;
6. limit cable-receiving groove;
7. tensioning steel cable;
8. mooring steel cable;
9. snap ring;
10. steel cable joint;
11. wing plate steel cable fixing point;
12. baffle; and
13. wing plate sliding baffle.

DESCRIPTION OF EMBODIMENTS

Figure 1:
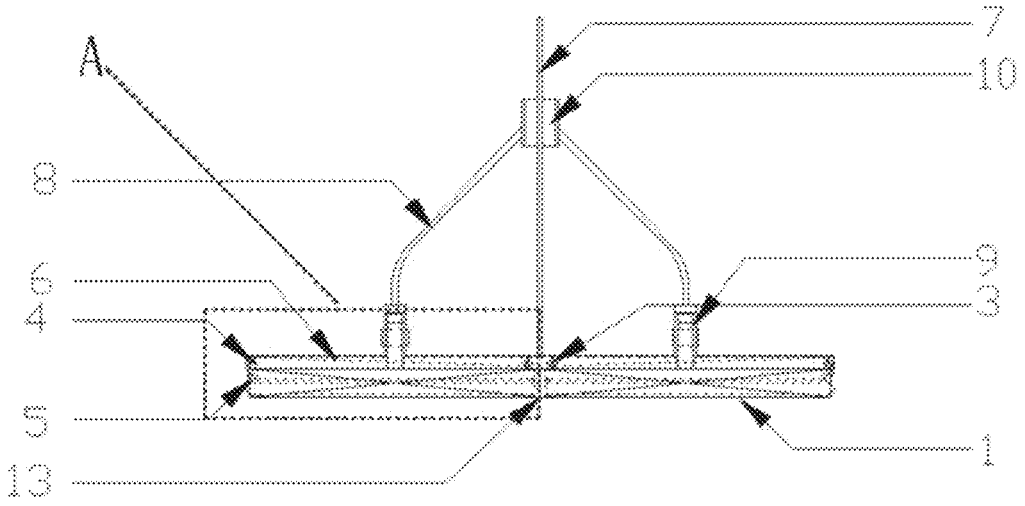
FIG. 1 is a front view when being in a retracted state.
Figure 2:
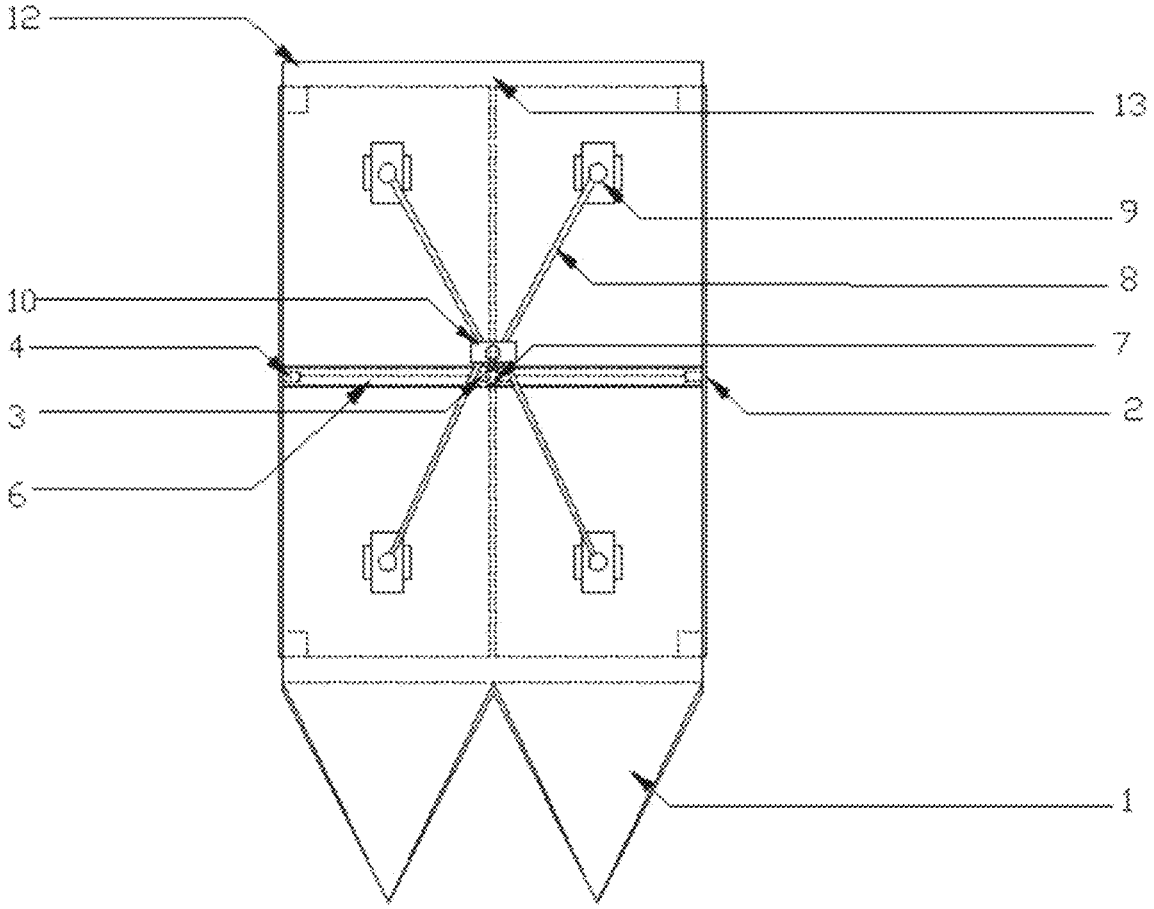
FIG. 2 is a top view when being in a retracted state.
Figure 3:
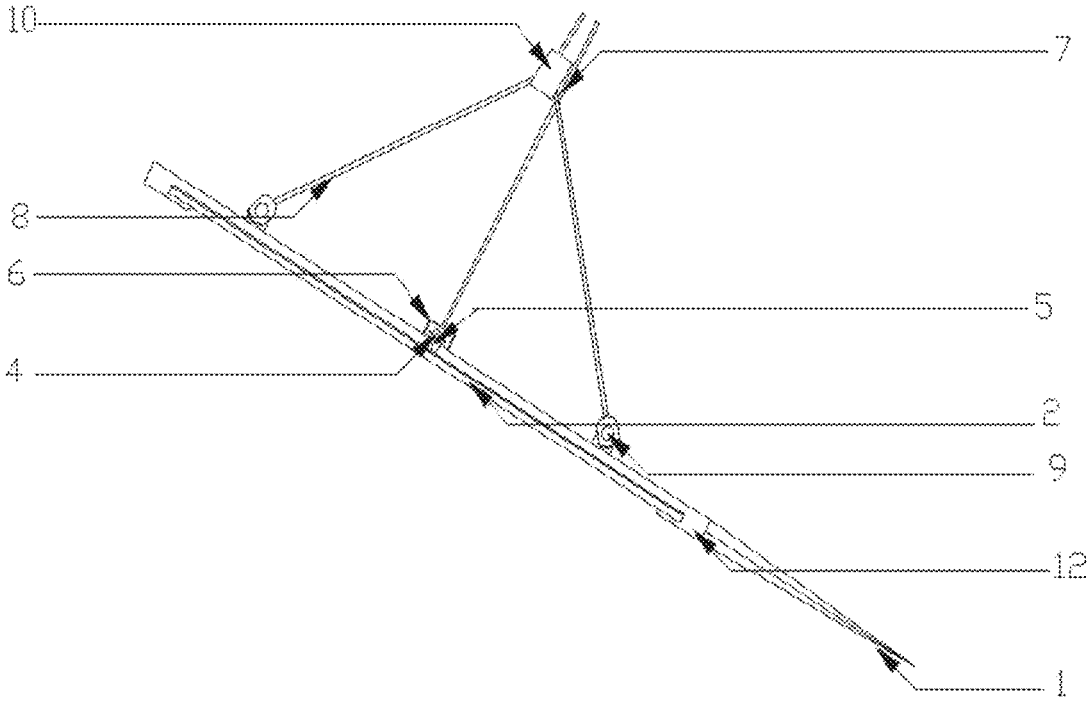
FIG. 3 is a side view when being in a retracted (extended) state.
Figure 4:
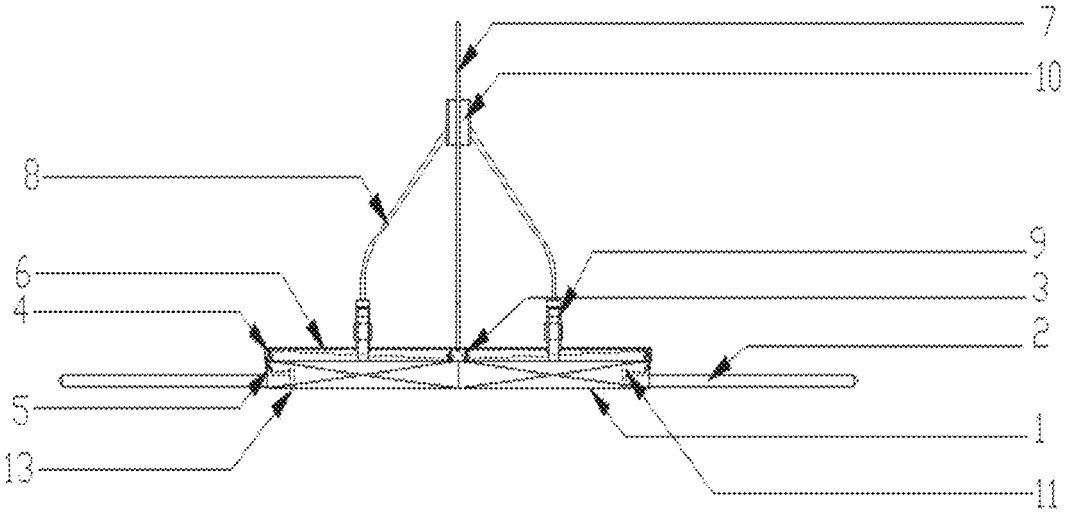
FIG. 4 is a front view when being in an extended state.
Figure 5:
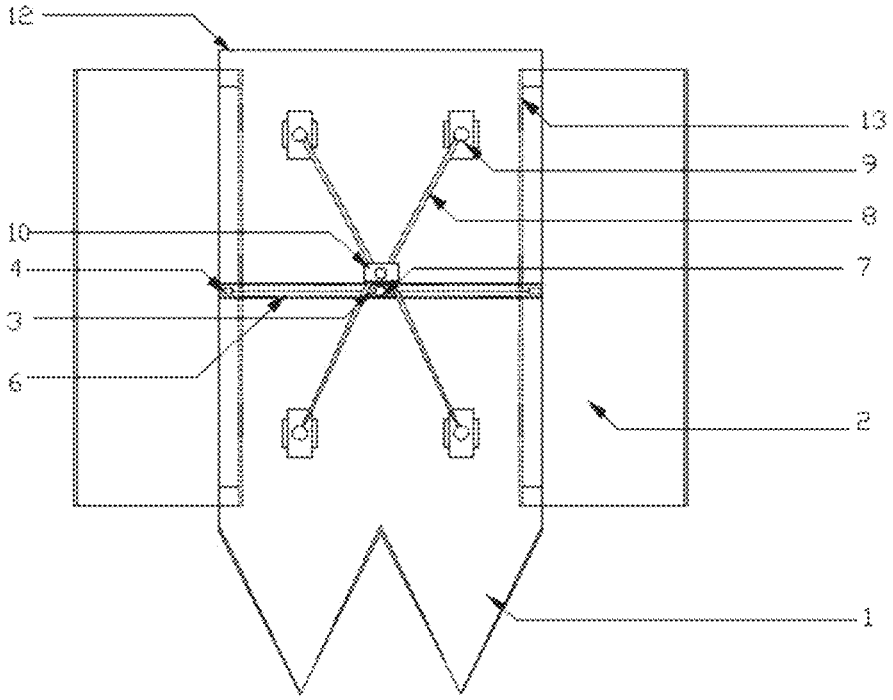
FIG. 5 is a top view when being in an extended state.
Figure 6:
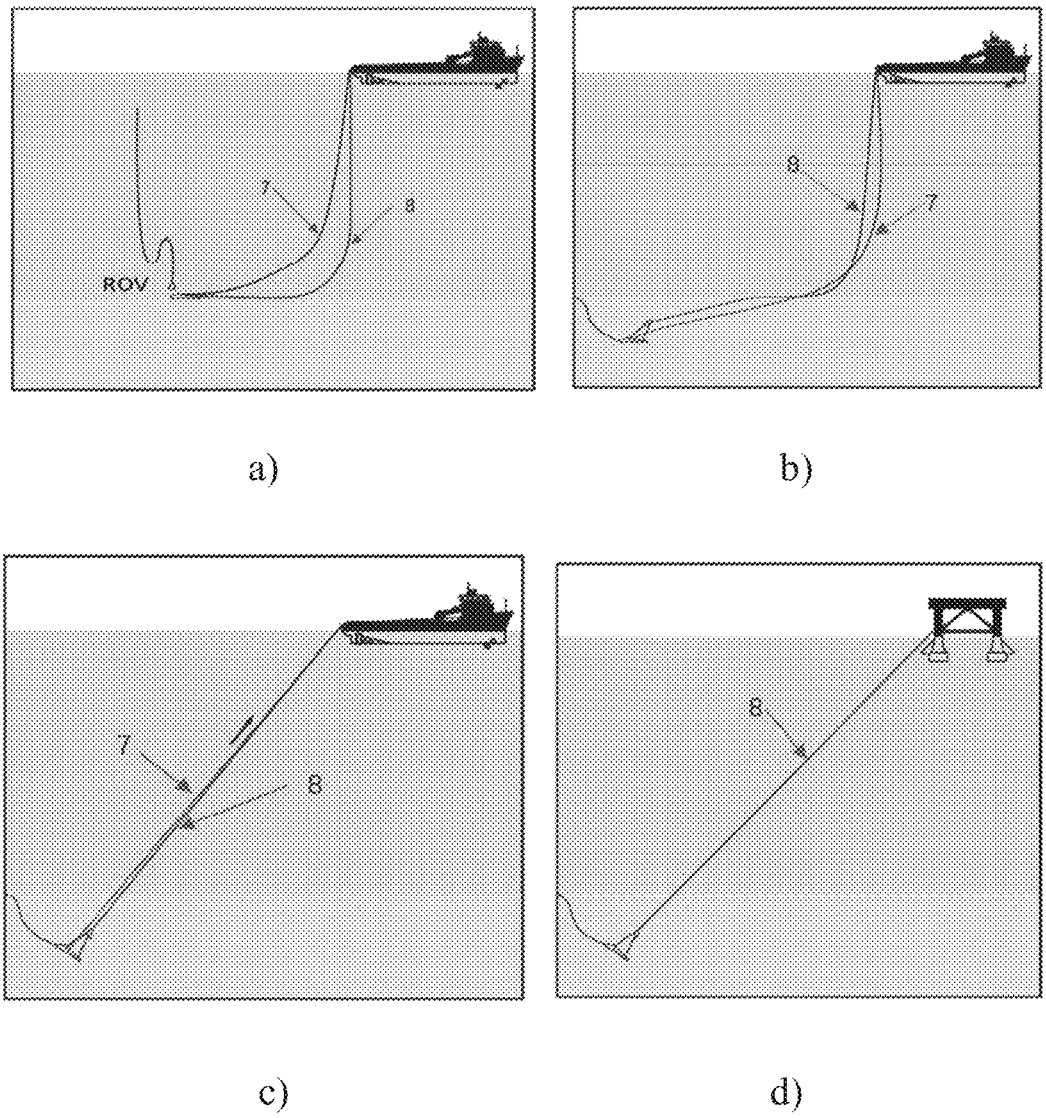
FIG. 6 is a schematic diagram illustrating an installation process according to the present disclosure.
Figure 7:
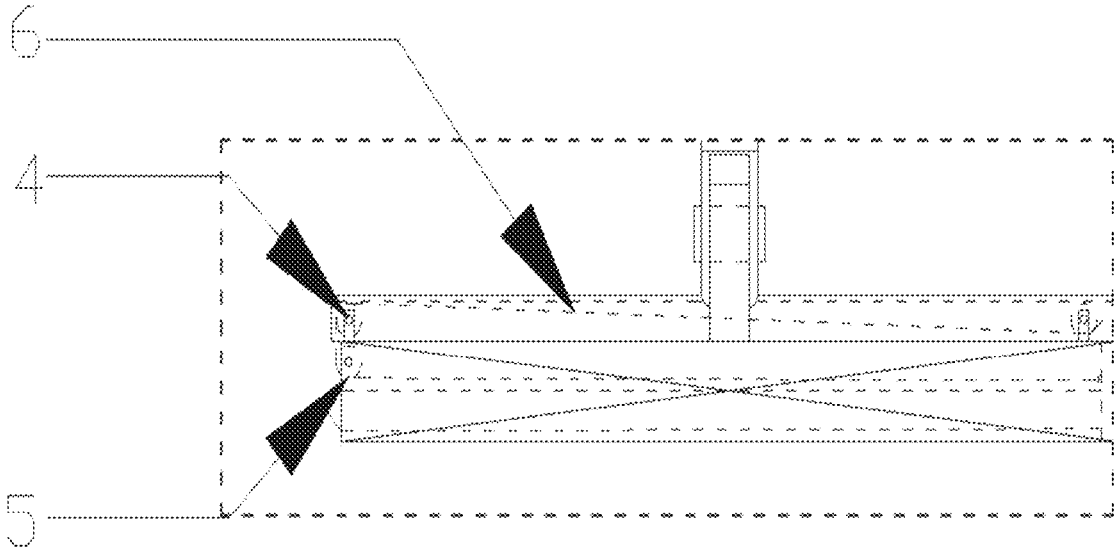
FIG. 7 is an enlarged schematic view of a structural detail A.
Figure 8:
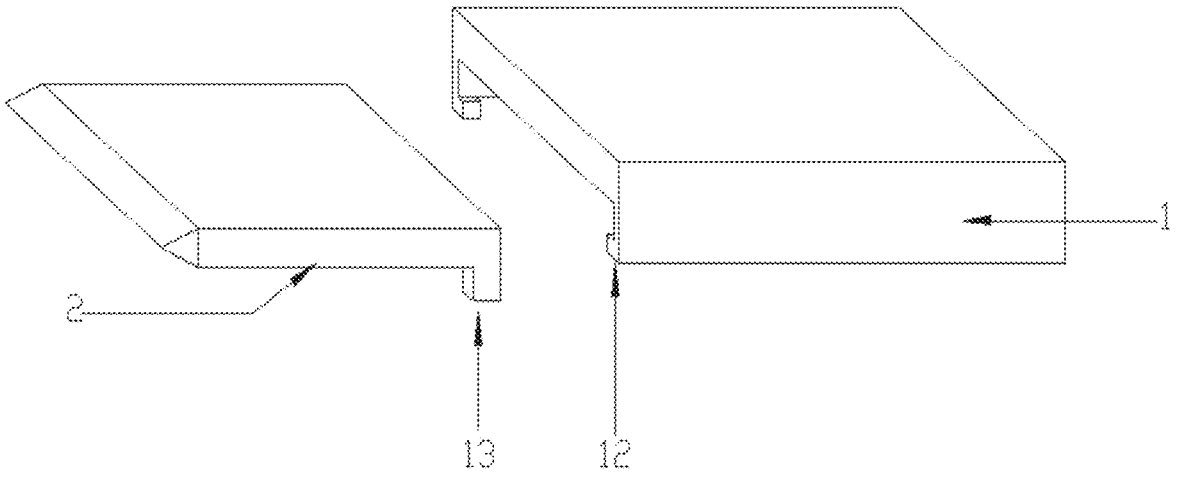
FIG. 8 is a diagram illustrating a structural detail of a main anchor plate and a wing plate.

As shown in FIGS. 1-8, a towing anchor capable of extending a wing plate is provided in the present disclosure. The towing anchor includes a main anchor plate 1 having an anchor tip, and two wing plates 2. Lower surfaces of four corners of the main anchor plate 1 are each provided with an L-shaped baffle 12. The two wing plates 2 are symmetrically arranged under the main anchor plate and are located between the L-shaped baffle 12 and the main anchor plate 1. An inner edge of each of the wing plates 2 is provided with a wing plate sliding baffle 13. When the wing plate 2 slides outwards, the wing plate will not be detached from the main anchor plate due to the L-shaped baffle 12 and the wing plate sliding baffle 13. The wing plate sliding baffle 13 may be a stopping block provided at both ends of the wing plate and corresponding to the two L-shaped baffles 12, or the wing plate sliding baffle 13 may be a stopping strip provided at an entire inner edge of the wing plate.

The main anchor plate 1 is provided with four snap rings 9 respectively tied with a mooring steel cable 8, and the four mooring steel cables are combined into one strand by a steel cable joint 10 and then connected to a towing vessel. The main anchor plate 1 is provided with a limit cable-receiving groove 6, which is formed by fixedly providing a strip-shaped cover on a surface of the main anchor plate. There is an opening at a middle position of the limit cable-receiving groove 6. In the limit cable-receiving groove 6, a first fixed pulley 3 is provided correspondingly to the inner edge of each of the wing plates, and a second fixed pulley 4 is provided correspondingly to an outer edge of each of the wing plates. Two outer edges of the main anchor plate 1 are each provided with a third fixed pulley 5. One end of the tensioning steel cable 7 penetrates into a gap between the wing plate 2 and the main anchor plate 1 and is fixed to the inner edge of the wing plate 2, that is, a wing plate steel cable fixing point 11, and the other end of the tensioning steel cable 7 sequentially surrounds the third, second, and first fixed pulleys and then passes through the opening at the middle position of the limit cable-receiving groove 6 and then is connected to the towing vessel.

Each of the wing plates 2 can slide outwards relative to the main anchor plate 1, and a maximum sliding distance is a width of one wing plate. The limit cable-receiving groove 6 can keep the fixed pulleys 3 and 4 and the tensioning steel cable 7 in the cover, thereby preventing the tensioning steel cable and the fixed pulleys from being damaged during towing.

During on-site construction, in a process of towing, the anchor plate is in a retracted state, the anchor is embedded into a seabed at a certain angle by the towing vessel through the mooring steel cable 8, and after reaching a pre-embedded depth, tensioning begins. During the tensioning process, the anchor plate is pulled upwards as a whole by the mooring steel cable 8 directly connected to the snap ring 9 on the main anchor plate 1, and at the same time, the tensioning steel cable 7, which surrounds the first, second, and third fixed pulleys 3, 4, and 5 and is connected to the steel cable fixing point 11 on the wing plate, is pulled to make the wing plate 2 extend, and operation starts once being connected to a floating platform.

What is claimed is:

1. A towing anchor capable of extending a wing plate, comprising: a main anchor plate having an anchor tip; and two wing plates, wherein lower surfaces of four corners of the main anchor plate are each provided with a baffle, an end of each of the two wing plates is provided with a wing plate sliding baffle; the two wing plates are symmetrically arranged under the main anchor plate, and when the two wing plates slide relative to the main anchor plate, the two wing plates are not detached from the main anchor plate due to the baffles and the wing plate sliding baffles; the main anchor plate is provided with four snap rings respectively tied with a mooring steel cable, and the four steel cables are combined into one strand by a steel cable joint and are then connected to a towing vessel; the main anchor plate is provided with a limit cable-receiving groove, and an opening is formed at a middle position of the limit cable-receiving groove; in the limit cable-receiving groove, a first fixed pulley is provided correspondingly to an inner edge of each of the two wing plates, and a second fixed pulley is provided correspondingly to an outer edge of each of the two wing plates, two outer edges of the main anchor plate are each provided with a third fixed pulley; one end of a tensioning steel cable penetrates into a gap between each of the two wing plates and the main anchor plate and is fixed to the inner edge of the wing plate, and the other end of the tensioning steel cable sequentially surrounds the third, second, and first fixed pulleys and then passes through the opening formed at the middle position of the limit cable-receiving groove to be connected to the towing vessel.

2. The towing anchor capable of extending a wing plate according to claim 1, wherein the baffle is an L-shaped baffle, each of the two wing plates is located in a gap between the L-shaped baffle and the main anchor plate, and the wing plate sliding baffle is provided at the inner edge of the wing plate.

3. The towing anchor capable of extending a wing plate according to claim 2, wherein the wing plate sliding baffled is a stopping block corresponding to two baffles, or the wing plate sliding baffle a stopping strip provided at an entire inner edge of the wing plate.

4. The towing anchor capable of extending a wing plate according to claim 1, wherein the limit cable-receiving groove is formed by fixing a strip-shaped cover on the main anchor plate.

5. An installing method for the towing anchor capable of extending a wing plate according to claim 1, wherein when towing, the two wing plates are in a retracted state, the towing anchor is embedded into a seabed at a certain angle by the towing vessel through the mooring steel cable, in such a manner that the towing anchor is at a depth deeper than a pre-embedded position by 1 to 2 times a width of the main anchor plate; when tensioning, the towing anchor is pulled upwards as a whole by pulling the mooring steel cable, and at the same time, by pulling the tensioning steel cable, the two wing plates slide outwards to extend, so that operation starts once being connected to a floating platform.

6. The installing method for the towing anchor capable of extending a wing plate according to claim 5, wherein the baffle is an L-shaped baffle, each of the two wing plates is located in a gap between the L-shaped baffle and the main anchor plate, and the wing plate sliding baffle is provided at the inner edge of the wing plate.

7. The installing method for the towing anchor capable of extending a wing plate according to claim 6, wherein the wing plate sliding baffle is a stopping block corresponding to two baffles, or the wing plate sliding baffle is a stopping strip provided at an entire inner edge of the wing plate.

8. The installing method for the towing anchor capable of extending a wing plate according to claim 5, wherein the limit cable-receiving groove is formed by fixing a strip-shaped cover on the main anchor plate.

* * * * *